US007528809B2

(12) United States Patent
Sim

(10) Patent No.: US 7,528,809 B2
(45) Date of Patent: May 5, 2009

(54) ORGANIC LIGHT EMITTING DISPLAY

(75) Inventor: Jae Ho Sim, Daegu-si (KR)

(73) Assignee: LG Display Co., Ltd., Seoul (KR)

( * ) Notice: Subject to any disclaimer, the term of this patent is extended or adjusted under 35 U.S.C. 154(b) by 663 days.

(21) Appl. No.: 11/117,733

(22) Filed: Apr. 29, 2005

(65) Prior Publication Data

US 2006/0066251 A1 Mar. 30, 2006

(30) Foreign Application Priority Data

Sep. 24, 2004 (KR) ..... 10-2004-0077445

(51) Int. Cl.
*G09G 3/30* (2006.01)

(52) U.S. Cl. ..... 345/76; 315/169.3

(58) Field of Classification Search ..... 345/76–83; 315/169.3

See application file for complete search history.

(56) References Cited

U.S. PATENT DOCUMENTS 7,126,565 B2 * 10/2006 Kawasaki et al. ..... 345/76
2004/0155841 A1 * 8/2004 Kasai ..... 345/76
2004/0196224 A1 * 10/2004 Kwon ..... 345/82

* cited by examiner

*Primary Examiner*—Bipin Shalwala
*Assistant Examiner*—Kenneth B Lee, Jr.
(74) *Attorney, Agent, or Firm*—McKenna Long & Aldridge LLP

(57) ABSTRACT

An organic light emitting display for minimizing or preventing nonuniformity in image quality includes a first transistor having a gate electrode connected to a first selection signal, a source electrode connected to a data signal, and a drain electrode connected to a second node; a second transistor having a gate electrode connected to the first selection signal, a source electrode connected to a power voltage, and a drain electrode connected to a first node; a third transistor having a gate electrode connected to a second selection signal, a source electrode connected to a reference voltage, and a drain electrode connected to the second node; a capacitor connected between the first node and the second node; and a fourth transistor having a gate electrode connected to the first node, a source electrode connected to the power voltage, and a drain electrode connected to an organic light emitting diode.

7 Claims, 6 Drawing Sheets

ORGANIC LIGHT EMITTING DISPLAY

This application claims the benefit of Korean Patent Application No. 2004-77445, filed on Sep. 24, 2004, which is hereby incorporated by reference for all purposes as if fully set forth herein.

BACKGROUND OF THE INVENTION

1. Field of the Invention

The present invention relates to an organic light emitting display, and more particularly, to an organic light emitting display with a high image quality.

2. Discussion of the Related Art

An organic light emitting display is a self-luminous display that emits light by electrically exciting a fluorescent organic compound, and displays an image by driving N×M organic light emitting diodes (OLEDs).

There are two driving methods for the organic light emitting display, that is, a passive matrix (PM) method and an active matrix (AM) method. In the case of the PM method, anode electrodes and cathode electrodes are formed perpendicular to one another and the display is driven by selecting lines. In the case of the AM method, transistors and capacitors are connected to pixel electrodes and the display is driven to maintain voltages supplied from the transistors at the pixel electrodes using the capacitors.

FIG. 1 is a circuit diagram of one of N×M pixels in a related art AM organic light emitting display. Referring to FIG. 1, a unit pixel of the related art AM organic light emitting display includes a first transistor M1 (switching transistor), a second transistor M2 (driving transistor), a capacitor C1, and an OLED. Here, the first transistor M1 has a gate connected to a gate line 1, a source connected to a data line 2, and a drain connected to a node A. The second transistor M2 has a gate connected to the node A, and a source connected to a power supply line 3. The capacitor C1 is connected between the gate and source of the second transistor M2, and the OLED is connected to the drain of the second transistor M2.

The first transistor M1 is turned on by a selection signal Vs (or a scan signal) supplied through the gate line 1, and a data signal "Vdata" is supplied through the turned-on first transistor M1 to the node A. A voltage difference between both terminals of the capacitor C1 is a difference between a power voltage "VDD" and the data signal "Vdata". In the second transistor M2, a driving current "$I_{OLED}$ "of the OLED is determined according to the value of Vdata. The driving current "$I_{OLED}$ "is expressed as Equation 1 below.

$$I_{OLED}=K(VDD-V\text{data}-|V\text{th}|)^2 \quad \text{(Equation 1)}$$

In Equation 1, "$I_{OLED}$", "K", "VDD", "Vdata", and "Vth" represent a driving current of the OLED, a constant, a power voltage actually applied to the OLED, the data signal, and a threshold voltage of the second transistor M2, respectively.

The driving current $I_{OLED}$ of the OLED varies according to the data signal Vdata because the power voltage VDD and the threshold voltage Vth are generally constant. The luminance of light emitted from the OLED is determined according to the value of $I_{OLED}$. Accordingly, a desired gray scale can be produced from the OLED by changing the value of the data signal Vdata.

Meanwhile, an organic light emitting display, as well as other flat panel displays, is also being actively researched to increase the size of its screen. The power voltage VDD is supplied to all the pixels of the display through the power supply line 3 which is aligned vertically in FIG. 1 (that is, from an upper side to a lower side). Generally, the power supply line 3 has an inherent line resistance. In the case of a wide-screen organic light emitting display, the power supply line 3 has an increased line resistance due to its increased length. In such a case, a considerably reduced power voltage VDD is actually applied to the pixels located at a lower side of the display due to a voltage drop (IR drop) caused by the increased line resistance, while the pixels located at a upper side of the display are supplied with a predetermined power voltage VDD.

As expressed by Equation 1, an image gray scale can be accurately produced by the data signal Vdata when a desired power voltage VDD is uniformly supplied to all the pixels (or all the active pixels) in the display. However, as described above, although a desired power voltage VDD is supplied to all the pixels, the actual power voltage VDD supplied to the pixels located at a lower side of the display becomes smaller compared with the actual power voltage supplied to the pixels located at a upper side of the display. Accordingly, gray scales produced by the lower pixels become lower than gray scales produced by the upper pixels, thereby causing nonuniformity in image quality.

SUMMARY OF THE INVENTION

Accordingly, the present invention is directed to an organic light emitting display that substantially obviates one or more problems due to limitations and disadvantages of the related art.

An advantage of the present invention is to provide an organic light emitting display that can minimize or prevent nonuniformity in image quality by causing its OLEDs to emit the same light independently of a power voltage.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these advantages and in accordance with the purpose of the invention, as embodied and broadly described herein, an organic light emitting display includes a first transistor having a gate electrode connected to a first selection signal, a source electrode connected to a data signal, and a drain electrode connected to a second node; a second transistor having a gate electrode connected to the first selection signal, a source electrode connected to a power voltage, and a drain electrode connected to a first node; a third transistor having a gate electrode connected to a second selection signal, a source electrode connected to a reference voltage, and a drain electrode connected to the second node; a capacitor connected between the first node and the second node; and a fourth transistor having a gate electrode connected to the first node, a source electrode connected to the power voltage, and a drain electrode connected to an organic light emitting diode (OLED).

In another aspect of the present invention, an organic light emitting display includes a first transistor having a gate electrode connected to a selection signal, a source electrode connected to a data signal, and a drain electrode connected to a second node; a second transistor having a gate electrode connected to the selection signal, a source electrode connected to a power voltage, and a drain electrode connected to a first node; a third transistor having a gate electrode connected to the selection signal, a source electrode connected to a reference voltage, and a drain electrode connected to the second node; a capacitor connected between the first node and the second node; and a fourth transistor having a gate electrode connected to the first node, a source electrode connected to the power voltage, and a drain electrode connected to an organic light emitting diode (OLED).

In another aspect of the present invention, an organic light emitting display includes a first transistor having a gate electrode connected to a first selection signal, a source electrode connected to a data signal, and a drain electrode connected to a first node; a second transistor having a gate electrode connected to the first selection signal, a source electrode connected to a reference voltage, and a drain electrode connected to a second node; a third transistor having a gate electrode connected to a second selection signal, a source electrode connected to a power voltage, and a drain electrode connected to the second node; a capacitor connected between the first node and the second node; and a fourth transistor having a gate electrode connected to the first node, a source electrode connected to the power voltage, and a drain electrode connected to an organic light emitting diode (OLED).

In yet another aspect of the present invention, a display device having a plurality of pixels, each pixel of the display device includes a driving circuit having a switching transistor connected to a gate line and a data line and having a driving transistor coupled to the switching transistor and connected to a power line; a light emitting element connected to the driving transistor of the driving circuit; and a control circuit connected to the driving circuit and a reference voltage line for driving the light emitting element substantially independent of a voltage change in a power voltage supplied from the power line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

In the drawings.

DETAILED DESCRIPTION OF THE ILLUSTRATED EMBODIMENTS

Reference will now be made in detail to embodiments of the present invention, examples of which are illustrated in the accompanying drawings. Wherever possible, the same reference numbers will be used throughout the drawings to refer to the same or like parts.

Figure 1:
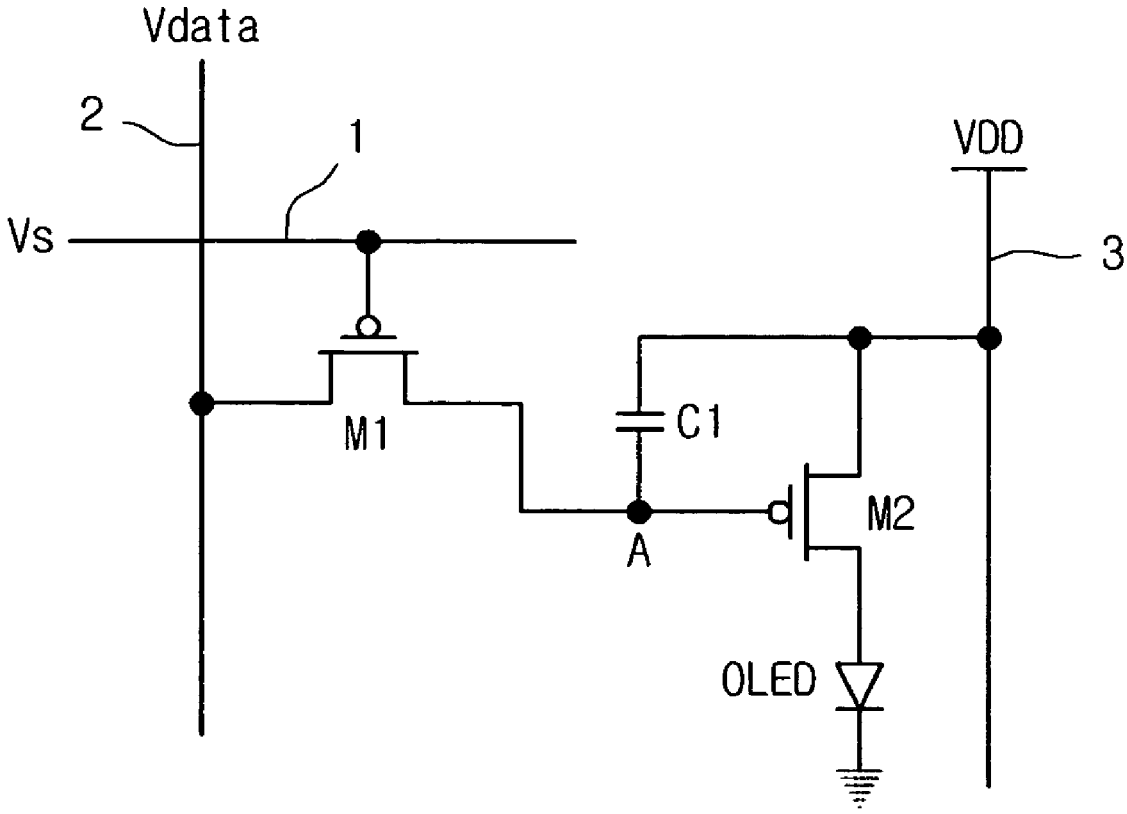
Fig.1 (Related Art)
FIG. 1 is a circuit diagram of a unit pixel of a related art AM organic light emitting display.
Figure 2:
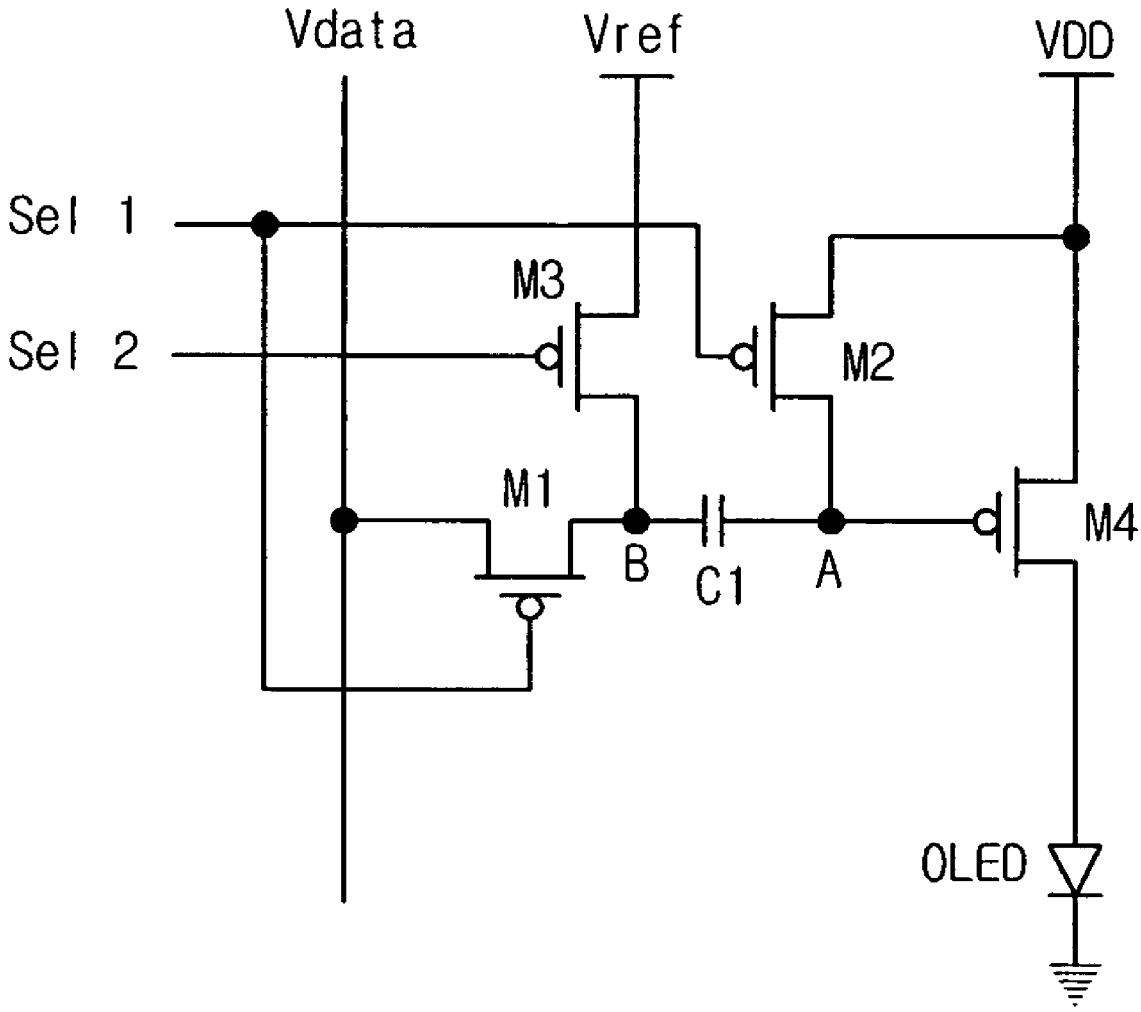
FIG. 2 is a circuit diagram of a unit pixel of an organic light emitting display according to a first embodiment of the present invention.

FIG. 2 is a circuit diagram of one unit pixel of N×M pixels in an organic light emitting display according to a first embodiment of the present invention. Referring to FIG. 2, in the organic light emitting display, a first selection signal "Sel1" is connected to a first and second transistors M1 and M2, and a second selection signal "Sel2" is connected to a third transistor M3. The first and second transistors M1 and M2 are turned on by the first selection signal Sel1, and the third transistor M3 is turned on by the second selection signal Sel2.

The first transistor M1 has a gate connected to the first selection signal Sel1, a source connected to a data signal "Vdata", and a drain connected to a second node "B". The second transistor M2 has a gate connected to the first selection signal Sel1, a source connected to a power voltage "VDD", and a drain connected to a first node "A". The third transistor M3 has a gate connected to the second selection signal Sel2, a source connected to a reference voltage "Vref", and a drain connected to the second node B. A capacitor C1 is connected between the first node A and the second node B. The fourth transistor M4 has a gate connected to the first node A, a source connected to the power voltage VDD, and a drain connected to an OLED.

In this embodiment, the first to fourth transistors M1 to M4 are PMOS transistors and thus are turned on by a low level signal. The first and second transistors M1 and M2 are turned on by a first selection signal Sel1 of a low level, and the third transistor M3 is turned on by a second selection signal Sel2 of a low level. The first and second transistors M1 and M2 are simultaneously turned on by the first selection signal Sel1 because they are commonly connected to the first selection signal Sel1.

Figure 3:
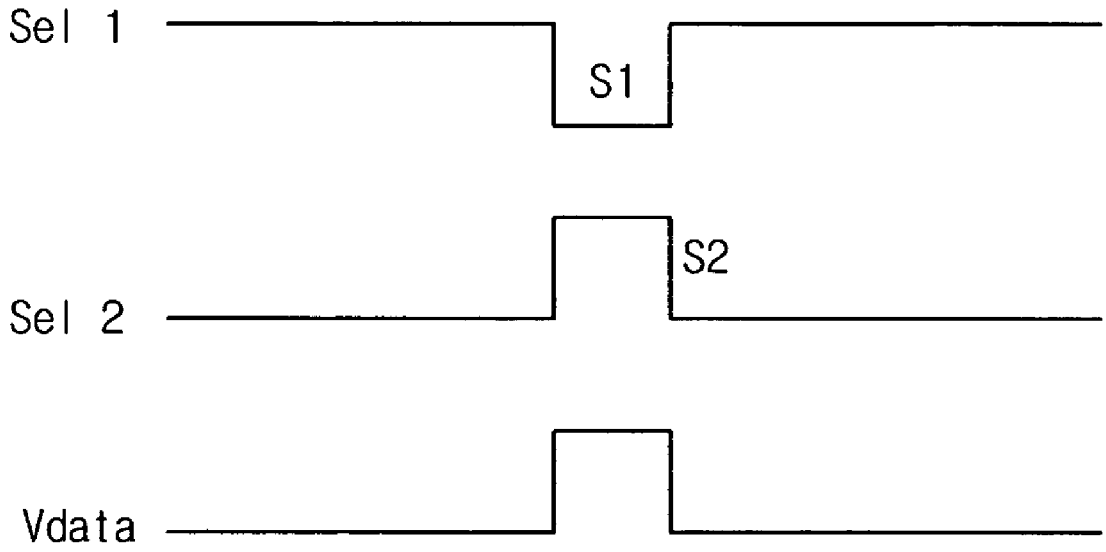
FIG. 3 is a diagram illustrating waveforms of selection signals and a data signal for driving the organic light emitting display shown in FIG. 2.

FIG. 3 is a diagram illustrating waveforms of selection signals and a data signal for driving the organic light emitting display shown in FIG. 2. An operation of the organic light emitting display according to the first embodiment will be described in detail with reference to FIGS. 2 and 3.

Referring to FIGS. 2 and 3, a pixel of the organic light emitting display is driven during first and second periods S1 and S2. During the first period S1, a first selection signal Sel1 of a low level and a data signal Vdata corresponding to a predetermined gray scale are applied to the pixel. During the second period S2, a second selection signal Sel2 of a low level is applied to the pixel. A power voltage VDD and a reference voltage Vref have predetermined DC (Direct Current) values, which may be different from each other. The first and second transistors M1 and M2 are turned on by the first selection signal Sel1 of a low level during the first period S1, and thus the power voltage VDD and the data signal Vdata are supplied to the first node A and the second node B, respectively. The capacitance Q of the capacitor C1 during the first period S1 is expressed as Equation 2 below.

$$Q=C1(VDD-V\text{data}) \quad \text{(Equation 2)}$$

Thereafter, the third transistor M3 is turned on by the second selection signal Sel2 of a low level during the second period S2, and thus the reference voltage Vref is supplied to the second node B. The capacitance Q' of the capacitor C1 during the second period S2 is expressed as Equation 3 below.

$$Q'=C1(\text{varied voltage at the node } A-\text{varied voltage at the node } B) \quad \text{(Equation 3)}$$

In Equation 3, the varied voltage at the node B equals the reference voltage Vref.

At this time, Q and Q' are sustained. Accordingly, Q equals Q' (Q=Q'). From Q=Q' and Equations 2 and 3, the varied voltage at the first node A is expressed as Equation 4 below.

$$\text{Varied voltage at the node } A=VDD-V\text{data}+V\text{ref} \quad \text{(Equation 4)}$$

Here, the varied voltage at the first node A corresponds to a gate voltage "Vg" of the fourth transistor M4. Accordingly, a gate-power voltage "Vgs" of the fourth transistor M4 equals VDD-VDD+Vdata-Vref, that is, Vdata-Vref.

The OLED emits light when the driving current $I_{OLED}$ flows through the fourth transistor M4. The driving current $I_{OLED}$ is expressed as Equation 5 below.

$$I_{OLED}=K(|V\text{gs}|-|V\text{th}|)^2=K(|V\text{data}-V\text{ref}|-|V\text{th}|)^2 \quad \text{(Equation 5)}$$

In Equation 5, "$I_{OLED}$", "K", "Vdata", "Vref", and "|Vth|" represent the driving current of the fourth transistor M4, a constant, a data signal (voltage), the reference voltage, and a threshold voltage of the fourth transistor M4, respectively.

As expressed by Equation 5, the driving current $I_{OLED}$ of the fourth transistor M4 is dependent on the data signal Vdata and is independent of the power voltage VDD. Accordingly, when a pixel circuit of a display device is constructed as described in the first embodiment, the driving current $I_{OLED}$ of the fourth transistor M4 becomes independent of the power voltage VDD. Therefore, although different power voltage VDDs are actually applied to the pixels depending on the location of the pixels due to a voltage drop caused by the inherent resistance of a power source line in a wide display panel, a display device including an organic light emitting display according to the first embodiment produces a uniform and desired gray scale, irrespective of the location of the pixels, thereby minimizing or preventing nonuniformity in image quality.

Figure 4:
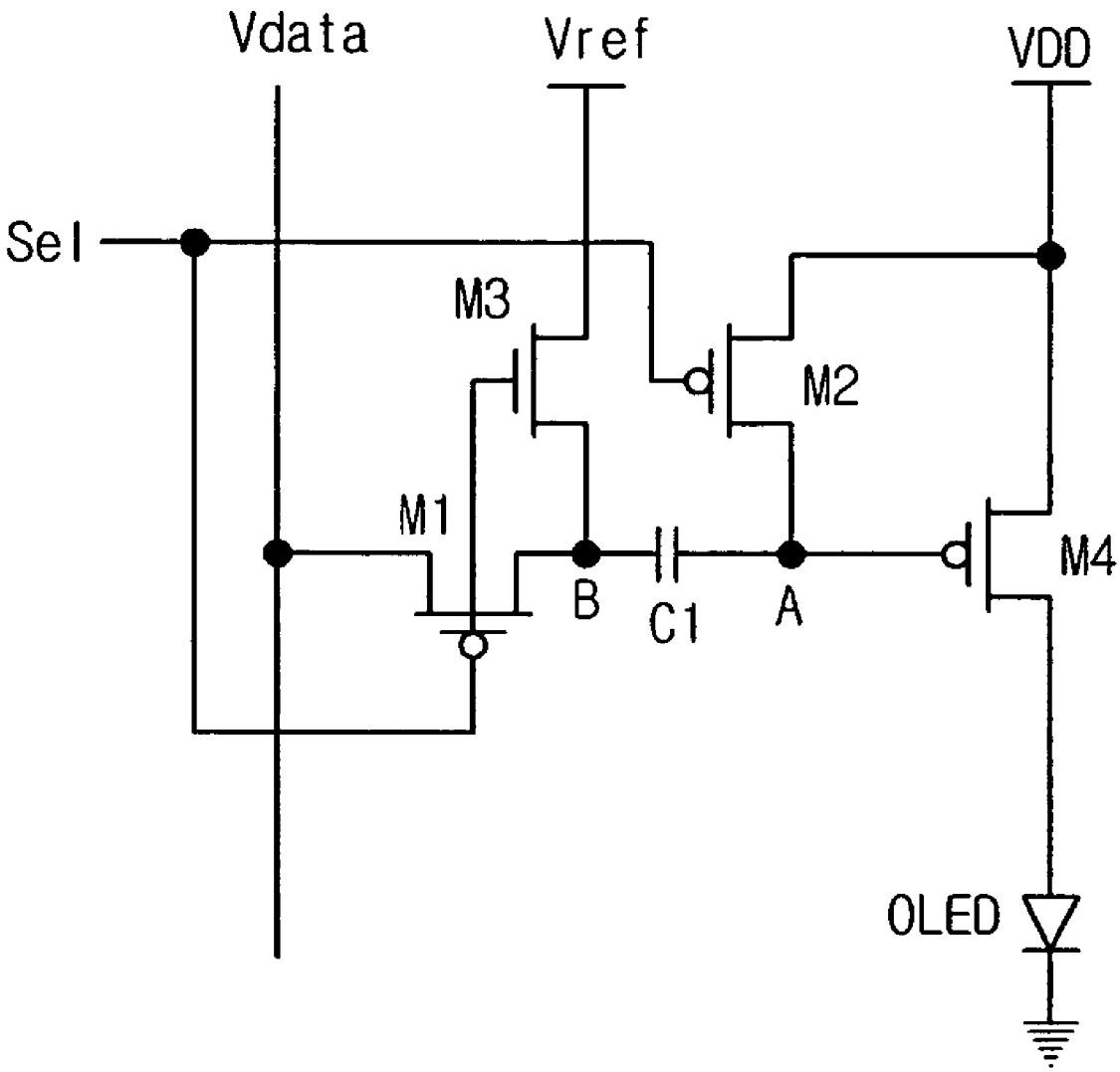
FIG. 4 is a circuit diagram of a unit pixel of an organic light emitting display according to a second embodiment of the present invention.

FIG. 4 is a circuit diagram of a unit pixel in N×M pixels in an organic light emitting display according to a second embodiment of the present invention. Referring to FIG. 4, the construction of the second embodiment is identical to the construction of the first embodiment with the exception that the third transistor M3 is an NMOS transistor and the first through third transistors M1 to M3 are all driven by one selection signal "Sel" in the second embodiment. Accordingly, the first and second transistors M1 and M2 are complementary to the third transistor M3. That is, by a selection signal Sel of a low level, the first and second transistors M1 and M2 are turned on and the third transistor M3 is turned off. On the contrary, by a selection signal Sel of a high level, the first and second transistors M1 and M2 are turned off and the third transistor M3 is turned on.

Figure 5:
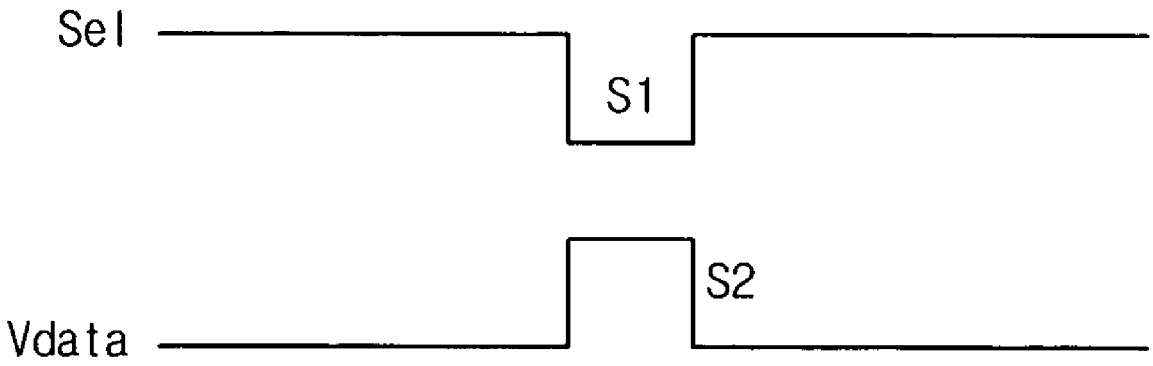
FIG. 5 is a diagram illustrating waveforms of a selection signal and a data signal for driving the organic light emitting display shown in FIG. 4.

FIG. 5 is a diagram illustrating waveforms of a selection signal and a data signal for driving the organic light emitting display shown in FIG. 4. An operation of the organic light emitting display according to the second embodiment will be described in detail with reference to FIGS. 4 and 5.

Referring to FIGS. 4 and 5, a pixel of the organic light emitting display is driven during first and second periods S1 and S2. During the first period S1, a selection signal Sel of a low level and a data signal Vdata corresponding to a predetermined gray scale are applied to the pixel. During the second period S2, a selection signal Sel of a high level is applied to the pixel. A power voltage VDD and a reference voltage Vref have predetermined DC values, which may be different from each other. The first and second PMOS transistors M1 and M2 are turned on by the selection signal Sel of a low level during the first period S1, and thus the power voltage VDD and the data signal Vdata are supplied respectively to the first node A and the second node B. As expressed by Equation 2, the capacitance Q of the capacitor C1 during the first period S1 becomes C1(VDD−Vdata).

Thereafter, the third NMOS transistor M3 is turned on by the selection signal Sel of a high level during the second period S2, and thus the reference voltage Vref is supplied to the second node B. As expressed by Equation 3, the capacitance Q' of the capacitor C1 during the second period S2 becomes C1(varied voltage at the node A−varied voltage at the node B). Here, the varied voltage at the node B equals the reference voltage Vref.

At this time, Q and Q' are sustained. Accordingly, Q equals Q' (Q=Q'). From Q=Q' and Equations 2 and 3, the varied voltage at the first node A is expressed as VDD−Vdata+Vref as shown in Equation 4. Here, the varied voltage at the first node A corresponds to a gate voltage "Vg" of the fourth transistor M4. Accordingly, a gate-power voltage "Vgs" of the fourth transistor M4 equals VDD-VDD+Vdata-Vref, that is, Vdata-Vref.

The OLED emits light when the driving current $I_{OLED}$ flows through the fourth transistor M4. The driving current $I_{OLED}$ becomes $K(|\text{Vdata-Vref}|-|\text{Vth}|)^2$ as expressed by Equation 5. Here, "$I_{OLED}$", "K", "Vdata", "Vref", and "|Vth|" represent the driving current of the fourth transistor M4, a constant, a data signal (voltage), the reference voltage, and a threshold voltage of the fourth transistor M4, respectively.

As expressed by Equation 5, the driving current $I_{OLED}$ of the fourth transistor M4 is dependent on the data signal Vdata and is independent of the power voltage VDD. Accordingly, when a pixel circuit of a display device is constructed as described in the second embodiment, the driving current $I_{OLED}$ of the fourth transistor M4 becomes independent of the power voltage VDD. Therefore, although different power voltage VDDs are actually applied to the pixels depending on the location of the pixels due to a voltage drop caused by the inherent resistance of a power source line in a wide display panel, a display device including an organic light emitting display according to the second embodiment produces a uniform and desired gray scale, irrespective of the location of the pixels, thereby minimizing or preventing nonuniformity in image quality.

Also, when a pixel circuit is constructed as described in the second embodiment, the number of signal lines can be reduced and a circuit structure can be simplified as compared with a pixel circuit constructed according to the first embodiment. This is because the first to third transistors M1 to M3 are driven by one selection signal Sel, instead of by two selection signals (the first and second signals Sel1 and Sel2).

Figure 6:
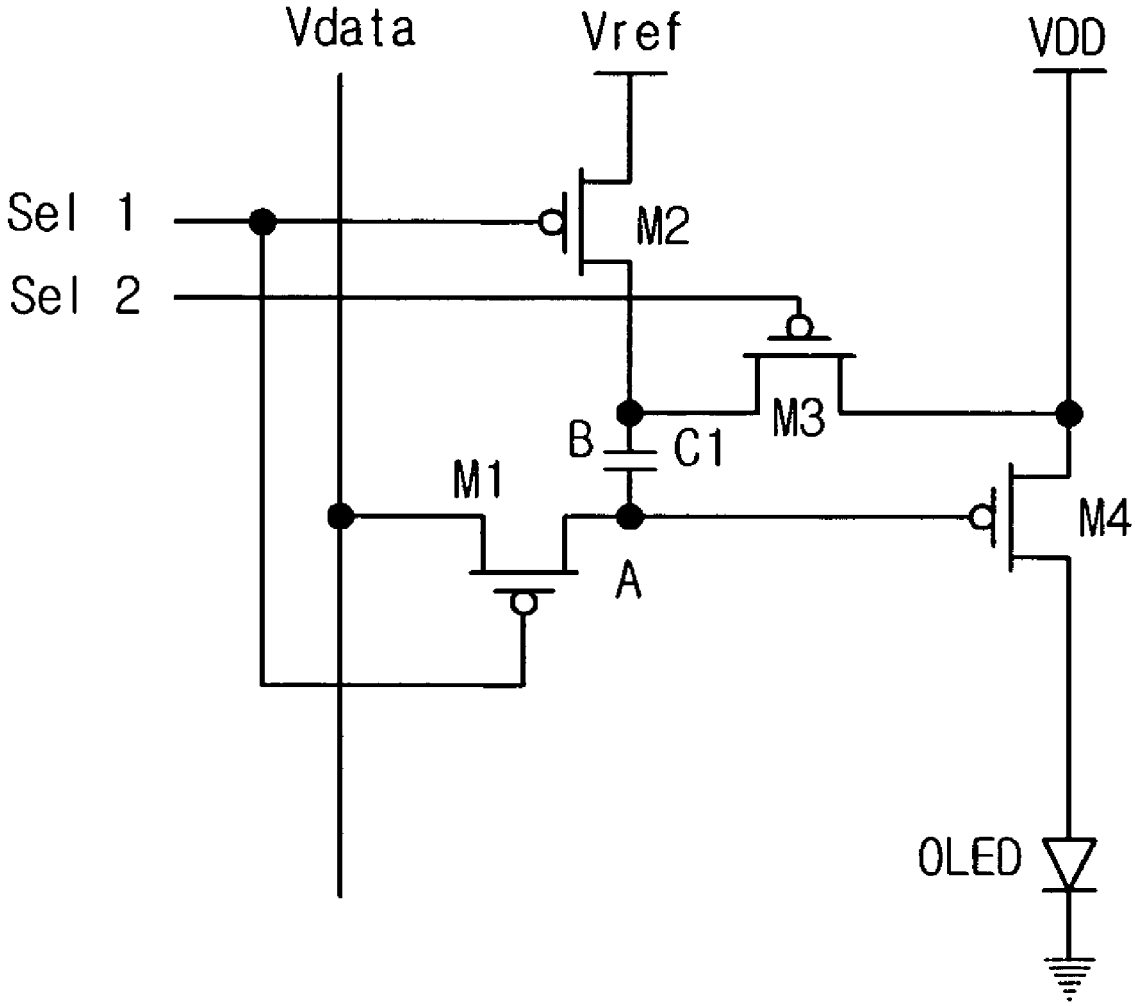
FIG. 6 is a circuit diagram of a unit pixel of an organic light emitting display according to a third embodiment of the present invention.

FIG. 6 is a circuit diagram of a unit pixel in N×M pixel arrays in an organic light emitting display according to a third embodiment of the present invention. Referring to FIG. 6, in the organic light emitting display according to the third embodiment, a first selection signal "Sel1" is connected to a first and second transistors M1 and M2, and a second selection signal "Sel2" is connected to a third transistor M3. The first and second transistors are turned on by the first selection signal Sel1, and the third transistor is turned on by the second selection signal Sel2.

In detail, the first transistor M1 has a gate connected to the first selection signal Sel1, a source connected to a data signal "Vdata", and a drain connected to a first node "A". The second transistor M2 has a gate connected to the first selection signal Sel1, a source connected to a reference voltage "Vref", and a drain connected to a second node "B". The third transistor M3 has a gate connected to the second selection signal Sel2, a source connected to a power voltage "VDD", and a drain connected to the second node B. The capacitor C1 is connected between the first node A and the second node B. The fourth transistor M4 has a gate connected to the first node A, a source connected to the power voltage VDD, and a drain connected to an OLED.

The first to fourth transistors M1 to M4 are PMOS transistors, and thus turned on by a low level signal. In detail, the first and second transistors M1 and M2 are turned on by a first selection signal Sel1 of a low level, and the third transistor M3 is turned on by a second selection signal Sel2 of a low level. The first and second transistors M1 and M2 are simultaneously turned on by the first selection signal Sel1 because they are commonly connected to the first selection signal Sel1. Accordingly, the organic light emitting display according to the third embodiment can be driven by the waveforms shown in FIG. 3.

The first and second transistors M1 and M2 are turned on by the first selection signal Sel1 of a low level during the first period S1, and thus the data signal Vdata and the reference voltage Vref are supplied respectively to the first node A and the second node B. The capacitance Q of the capacitor C1 during the first period S1 is expressed as Equation 6 below.

$$Q=C1(V\text{data}-V\text{ref}) \quad \text{(Equation 6)}$$

Thereafter, the third transistor M3 is turned on by the second selection signal Sel2 of a low level during the second period S2, and thus the power voltage VDD is supplied to the second node B. The capacitance Q' of the capacitor C1 during the second period S2 is expressed as Equation 7 below.

$$Q'=C1(\text{varied voltage at the node } A-\text{varied voltage at the node } B) \quad \text{(Equation 7)}$$

In Equation 7, the varied voltage at the second node B equals the power voltage VDD.

At this time, Q and Q' are sustained. Accordingly, Q equals Q' (Q=Q'). From Q=Q' and Equations 6 and 7, the varied voltage at the first node A is expressed as Equation 8 below.

$$\text{Varied voltage at the first node } A=VDD+V\text{data}-V\text{ref} \quad \text{(Equation 8)}$$

Here, the varied voltage at the first node A equals a gate voltage "Vg" of the fourth transistor M4. Accordingly, a gate-power voltage "Vgs" of the fourth transistor M4 equals VDD-(VDD+Vdata-Vref), that is, Vref-Vdata.

The OLED emits light when the driving current $I_{OLED}$ flows through the fourth transistor M4. The driving current $I_{OLED}$ is expressed as Equation 9 below.

$$I_{OLED}=K(|V\text{gs}|-|V\text{th}|)^2=K(|V\text{ref}-V\text{data}|-|V\text{th}|)^2 \quad \text{(Equation 9)}$$

In Equation 9, "$I_{OLED}$", "K", "Vdata", "Vref", and "|Vth|" represent the driving current of the fourth transistor M4, a constant, a data signal (voltage), the reference voltage, and a threshold voltage of the fourth transistor M4, respectively.

As expressed by Equation 9, the driving current $I_{OLED}$ of the fourth transistor M4 is dependent on the data signal Vdata and is independent of the power voltage VDD. Accordingly, when a pixel circuit is constructed as described in the third embodiment, the driving current $I_{OLED}$ of the fourth transistor M4 becomes independent of the power voltage VDD. Therefore, although different power voltage VDDs are actually applied to the pixels depending on the location of the pixels due to a voltage drop caused by the inherent resistance of a power source line in a wide display panel, a display device including an organic light emitting device according to the third embodiment produces a uniform and desired gray scale, irrespective of the location of the pixels, thereby minimizing or preventing nonuniformity in image quality.

As described above, by constructing a pixel in such a way that a driving current for the OLED to emit light is independent of the power voltage influence, a display device including an organic light emitting display according to the present invention produces a uniform and desired gray scale throughout the display, thereby minimizing or preventing nonuniformity in image quality.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An organic light emitting display comprising:

a first transistor having a gate electrode connected to a first selection signal, a source electrode connected to a data signal, and a drain electrode connected to a second node;

a second transistor having a gate electrode connected to the first selection signal, a source electrode connected to a power voltage, and a drain electrode connected to a first node;

a third transistor having a gate electrode connected to a second selection signal, a source electrode connected to a reference voltage, and a drain electrode connected to the second node;

a capacitor connected between the first node and the second node; and a fourth transistor having a gate electrode connected to the first node, a source electrode connected to the power voltage, and a drain electrode connected to an organic light emitting diode (OLED), wherein during a first period, the data signal is supplied to the second node by switching the first transistor and the power voltage is supplied to the first node by switching the second transistor, and during a second period, the reference voltage is supplied to the second node by switching the third transistor such that a voltage relating to the power voltage, the data voltage and the reference voltage is charged at the first node, and wherein the reference voltage is different from the power voltage.

2. The apparatus according to claim 1, wherein the first through fourth transistors are the same type.

3. The apparatus according to claim 1, wherein a driving current independent of the power voltage flows through the fourth transistor under the control of the second transistor.

4. A display device having a plurality of pixels, each pixel of the display device comprising:

a first transistor having a gate electrode connected to a first selection signal, a source electrode connected to a data signal, and a drain electrode connected to a second node;

a second transistor having a gate electrode connected to the first selection signal, a source electrode connected to a power voltage, and a drain electrode connected to a first node;

a third transistor having a gate electrode connected to a second selection signal, a source electrode connected to a reference voltage, and a drain electrode connected to the second node;

a capacitor connected between the first node and the second node; and a fourth transistor having a gate electrode connected to the first node, a source electrode connected to the power voltage, and a drain electrode connected to a light emitting element, wherein during a first period, the data signal is supplied to the second node by switching the first transistor and the power voltage is supplied to the first node by switching the second transistor, and during a second period, the reference voltage is supplied to the second node by switching the third transistor such that a voltage relating to the power voltage, the data voltage and the reference voltage is charged at the first node, and wherein the reference voltage is different from the power voltage.

5. The display device according to claim 4, wherein the display device is an organic light emitting display.

6. The display device according to claim 4, wherein the light emitting element includes an organic light emitting diode.

7. The display device according to claim 4, wherein the first through fourth transistors are the same type.

* * * * *